United States Patent [19]

Parente et al.

[11] Patent Number: 4,470,600

[45] Date of Patent: Sep. 11, 1984

[54] GOLF CLUB

[75] Inventors: Richard E. Parente, Palm Springs; Richard De La Cruz, Pauma Valley, both of Calif.

[73] Assignee: Hickory Stick USA, Temecula, Calif.

[21] Appl. No.: 386,931

[22] Filed: Jun. 10, 1982

[51] Int. Cl.[3] ..... A63B 53/02; A63B 53/10

[52] U.S. Cl. ..... 273/80 B; 273/80.3; 273/80.5; 273/80.8

[58] Field of Search ..... 273/81 R, 80 A, 80 B, 273/80 C, 80 D, 80.2–80.9

[56] References Cited

U.S. PATENT DOCUMENTS

| | | | |
|---|---|---|---|
| 772,043 | 10/1904 | Kleinschmidt | 408/11 |
| 1,513,350 | 10/1924 | Stolle | 408/59 |
| 1,564,208 | 12/1925 | Connolly | 273/80 A |
| 2,066,962 | 1/1937 | Cross | 273/80 A |
| 2,085,915 | 7/1937 | MacCallum | 273/80 R |
| 3,368,257 | 2/1968 | Andreasson | 29/106 |
| 3,502,124 | 3/1970 | Mater | 144/13 |
| 3,606,326 | 9/1971 | Sparks et al. | 273/81 R |
| 3,738,765 | 6/1973 | Mater | 408/37 |
| 3,854,838 | 12/1974 | Barnett et al. | 408/59 |
| 4,119,388 | 10/1978 | Armitage | 408/11 |

*Primary Examiner*—George J. Marlo
*Attorney, Agent, or Firm*—Duane C. Bowen

[57] ABSTRACT

A golf club with an outer tube formed from hickory, ash or birch and with an inner hollow tube formed of chrome-moly or other steelalloy aluminum, titanium, graphite fibers, boron fibers, graphite-boron fibers or fiberglass fibers. The outer tube has a bore of uniform diameter from end to end that closely fits the inner tube which has uniform inner and outer diameters from end to end. An epoxy adhesive bonds the tubes together. The wood tube is bored by a riflebore drill on an engine lathe, from a larger piece of wood which is turned to a smaller diameter after drilling. An extension of the shaft upper end of lower weight-to-length ratio than the remainder of the shaft, formed at least partly of plastic foam, and secured with a cylindrical boss bonded within the upper end of the inner tube. The lower end of the shaft is confined, to reduce hairline splitting of the wood tube, by the club head hosel or by cord whipping, and the shaft has various kinds of connections to the club head.

18 Claims, 18 Drawing Figures

GOLF CLUB

BRIEF SUMMARY OF THE INVENTION BACKGROUND AND OBJECTIVES

Our invention concerns a golf shaft with an outer wood tube and an inner tube bonded therein and made out of metal or other conventional material.

Objectives of our invention include to improve a golf club in respect to the following (which are illustrated respectively in FIGS. 12–16):

(a) To reduce radial torque or twisting of club head and shaft that is aggravated by off-center hits of the ball by the head. This will be called "twisting" herein.

(b) To reduce flexing or bending of the shaft in downswing prior to ball impact. Less flexing will mean less distance for the club head to travel to recover normal club disposition in which the axis of the shaft is a straight line. This will be called "downswing flexing" herein.

(c) To reduce flexing or bending of the shaft past the recovered position. The more the shaft flexes during the upswing past the recovered position the more the shaft flexing adds loft to the club face and the more the head and shaft twist which misaligns the club face to the right thereby deflecting the ball to the right. This will be called "flexing and twisting after recovery" herein.

(d) To reduce flexing of the shaft caused by centrifugal force that makes the toe of the club head hit the ground before the heel. This will be called "club head toeing" herein.

(e) To reduce vibrations as the ball is struck in general and to dampen the harsh vibrations particularly caused by off-center hits, by hardcovered balls, by cold weather conditions, by cast steel heads, and by other deficiencies in club constructions. This will be called "club vibration" herein.

Further objectives include: to improve a golf club in the foregoing respects while maintaining the weight thereof at about the level of clubs with conventional shafts; to provide a club of improved feel; to devise a way to satisfactorily bore the wood part of the shaft; to provide means to alleviate the problem of hairline cracks at the lower end of the wood part of the shaft; to devise means to join the club head to the combined outer wood tube and inner tube made of conventional material; to provide an improved golf club in various aspects of flexing, twisting and vibration while maintaining other desirable characteristics of conventional golf clubs; to devise an attractive club having the appearance of a wood shaft while providing suitable economy of manufacture considering the quality of the product and while providing suitable durability; and to provide a golf club shaft with the appearance and softer feel of wood, especially hickory, and with the reliability and consistency of steel.

A preliminary examination search was conducted and the searcher cited patents identified as follows:

U.S. Pat. No. 2,085,915
U.S. Pat. No. 3,502,124
U.S. Pat. No. 4,119,388
U.S. Pat. No. 772,043
U.S. Pat. No. 3,738,765
U.S. Pat. No. 3,368,257
U.S. Pat. No. 1,513,350

U.S. Pat. No. 3,854,838

The only patent cited concerning a golf club shaft, which was made of more than one material, is U.S. Pat. No. 2,085,915 but in cross-section that patent specifies packing material between inner and outer annular metal parts. The other search patents concern lathes, boring wood poles, etc., and were not devoted to golf clubs. U.S. Pat. No. 1,513,350 describes drilling wood objects with a rifle bore drilling machine. U.S. Pat Nos. 3,738,765 and 3,502,124 describe drilling of poles and the use of air, rather than liquid, to convey chips during wood drilling. All-wood shafts become largely replaced with metal upon legalization of metal by the USGA about 1925. The wood shafts were unsatisfactory because of various physical properties, i.e., warping, low strength in torque, breakage, etc.

Our invention will be best understood, together with additional advantages and objectives thereof, when read with reference to the drawings.

THE DRAWINGS

DESCRIPTION

Figures 1, 2, 3, 4, 5, 6, 7:
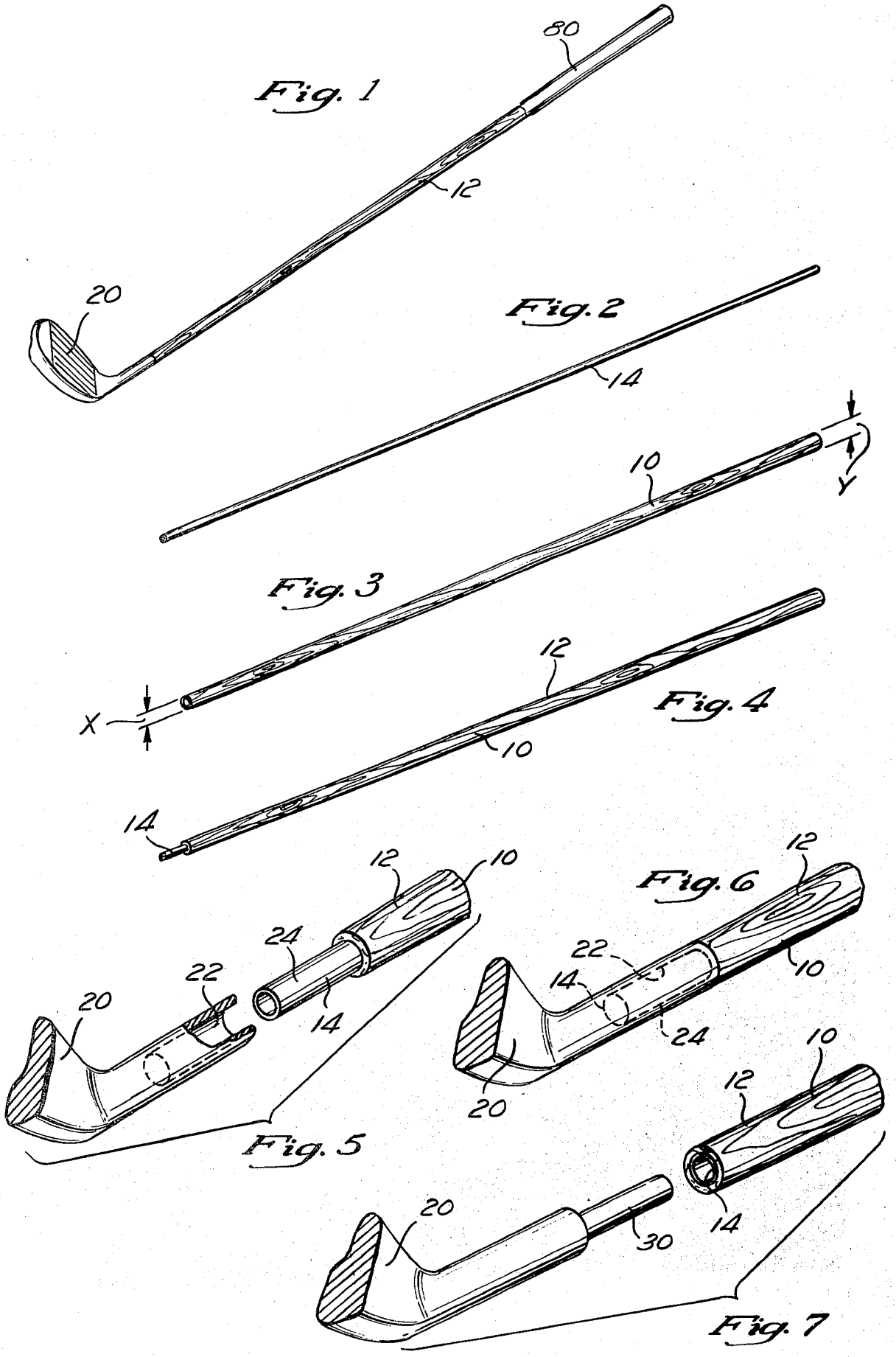
FIG. 1 is a perspective view of a golf club embodying our new invention.
FIG. 2 is a perspective view of an inner non-wood tube.
FIG. 3 is a perspective view of an outer wood tube.
FIG. 4 is a perspective view of a club shaft without club head.
FIG. 5 is a partial, exploded perspective view of a first form of joinder of shaft and head.
FIG. 6 is like FIG. 5 but with parts in joined position.
FIG. 7 is a partial, exploded perspective view of a second form of joinder of shaft and head.

Our invention includes preferably the use of a true hickory shaft with a specially designed thin-walled, light-weight steel liner down the center. The combination of hickory and steel produces a more playable shaft than has been known previously in the art. A club shaft made according to our invention, of all head types and sizes, has the reliability, consistency and playability of steel along with the looks and feel of hickory. The harsh feel of investment cast irons and of balls with hard coverings can be greatly reduced by this "hickory stick". The natural wood absorbs harsh vibrations and produces a soft feel golfers liked before the advent of steel shafts. The combined hickory-steel shaft produces unique flex characteristics and low torque which results in a more accurate shaft than has been known previously in the art. Several head designs have been used to complement the hickory-steel shaft. A leather grip also may be used as an associated high quality detail. In all, it is believed a superior golf club has been provided over what has been known in the art before.

An outer solid wood tube 10 of the golf club shaft 12 preferably is made of hickory but may be made of other wood. A Markush expression for a preferred list of woods is a material selected from the group consisting of hickory, ash, and birch.

An inner rigid thin-walled non-wood tube 14 of shaft 12 is positioned inside of and closely fits the interior of outer tube 10. Inner tube 14 preferably is formed of chrome-moly steel. A Markush expression for a preferred list of materials for inner tube 14 is a material selected from the group consisting of chrome-moly steel, other steel alloys, aluminum, bonded graphite fibers, bonded boron fibers, and bonded fiberglass fibers.

As adhesive 23 is used between the interior of outer tube 10 and the exterior of inner tube 14. A preferred adhesive is an epoxy.

In order for a golf club shaft 12 to be workable, which is laminated by an outer wood tube 10 and an inner non-wood tube 14, the two tubes must be closely fitting, meaning that tolerances of manufacturing must be suitably controlled. An example of dimensions and tolerances would be 0.370±0.002" OD for tube 14 and 0.375−zero+0.004" ID for tube 10. Working with such tolerances is no special problem with the non-wood materials above specified for inner non-wood tube 14. Tolerances of that order are common and particularly with the metals.

The problem is in boring wood for outer tube 10 with tolerances such as are given above. Early experiments indicated, in fact, that is was impossible to maintain such tolerances. Prior long bore wood drills, used in drilling wood lamp standards and the like, did not hold tolerances and were particularly bad in wandering of the drill centers. Without controlled tolerances, the combined wood-metal shaft was impossible. The closely desired tolerances of the ID of wood tube 10 became possible only when we arrived at certain special boring techniques, which have proven to produce tubes within the tolerances needed, including the following:

(a) We use a larger block or cylinder of wood and only after the interior is bored do we then turn the exterior on a lathe to produce the desired exterior surface. It will be understood that the interior tolerances are the critical problems first because the interior tolerances mate with the inner tube 14 and second because holding close tolerances in exterior tolerances in turning wood is not a severe problem, for example. We routinely turn the larger block or cylinder to ±0.005" tolerances after achieving satisfactory interior boring. Using the larger block or cylinder decreases the problem of deflection of the material during boring. An example, is to start with a preturned ¾" hickory dowel and to bore a 0.375 bore−zero+0.004". The Stolle patent, U.S. Pat No. 1,513,350, Page 4, lines 112–130, describes boring wood before turning the same in the prior art.

(b) We conceived of the use of a riflebore drill to produce the bore in tube 10. Greatly improved results were achieved from use of this precision drilling instrumentality. The preliminary examination search herein disclosed U.S. Pat. No. 1,513,350 to Stolle in which rifle-bore drilling machines manufactured by Pratt & Whitney and by Baush Machine Tool were used to drill bobbins and spools and to drill reinforced peavey and hammer handles, whiffle-trees, etc.

(c) We prefer to use forced air to carry chips away from the drill. The air also has some cooling or lubricating functions. The preliminary examination search herein disclosed prior use of air to dispose of wood chips in boring, i.e., Mater U.S. Pat Nos. 3,502,124 and 3,738,765 and Barnett U.S. Pat No. 3,854,838 in boring poles upward of forty feet in length and in boring hydro poles.

(d) In order to obtain the precision needed in boring we have found it important to adopt an engine lathe for boring operations.

Our experience is that the use of these measures (a), (b), (c) and (d) has produced bored tubes 10 within tolerances at a minimal rejection rate.

Moisture conditions are important in wood which can swell or contract depending on moisture content. Either relative humidity should be controlled between the time of boring of tube 10 and the time of laminating of tube 14 therein or the lamination process should be conducted very soon after boring if relative humidity is not controlled.

A grip 80, preferably of leather, covers the upper end of shaft 12, as is conventional in shaft manufacture. The exterior of shaft 12 and outer tube 10 tapers from the upper to lower ends, i.e., dimension "y" in FIG. 3, is larger than dimension "x".

Usually tube 10 will be fabricated from standard wood dowel stock. However, we do not want to state it would be impossible to fabricate tube 10 from a laminated block of wood, although at present it seems the natural solid block of wood is preferable.

Because wood tube 10 can be turned down to a small diameter like that in steel clubs, a rubber grip 80 can be used, which is preferred by most players.

Golf club head 20 is secured to the lower end of club shaft 10. In the FIGS. 5 and 6 construction, club head 20 has a cylindrically contoured hosel socket 22 of a size to fit a portion 24 of inner tube 14 extending beyond the lower end of outer tube 10. In the various structures to fasten head 20 to shaft 10 shown, an adhesive, such as an epoxy material, is preferred to secure shaft 10 in the club hosel 22 or the like.

The FIG. 7 construction can be considered to be the opposite of the FIGS. 5–6 construction in that the inside of inner tube 14 is treated as a socket and club head 20 has a cylindrical boss 30 secured within inner tube 14. In the FIG. 7 construction, the lower ends of the inner tube 14 and the outer tube 10 can be terminated in the same lateral plane.

Because of the torsion to which particularly the lower end of shaft is subjected, we have discovered that hairline cracks can develop in the lower end of outer wood tube 10 and we have conceived several measures to control or reduce such splitting, which are shown in FIGS. 8–11.

Figure 8:
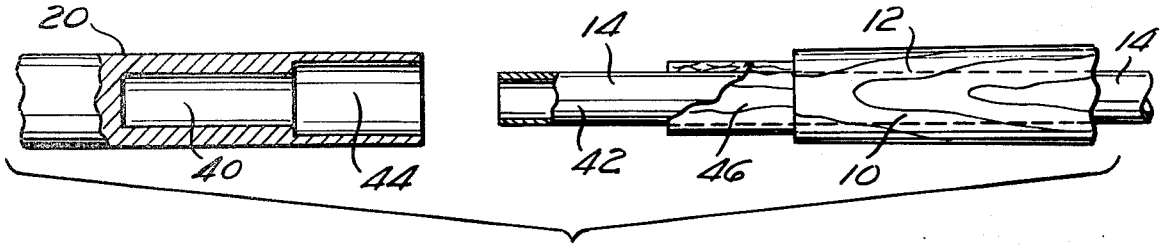
FIG. 8 is a partial, exploded side view of a third form of joinder of shaft and head.

In FIG. 8, the hosel socket has a smaller lower cylindrical portion 40 to accept the lower end 42 of inner tube 14 and a larger upper cylindrical portion 44 to accept a reduced diameter lower portion 46 of outer wood tube 10. Reduced diameter wood portion 46 can be produced by turning. When wood portion 46 is epoxied into socket 44, the tendency to produce hairline cracks is reduced and any cracks occurring are confined and protected and the tendency for cracks to propogate is reduced.

Figure 9:
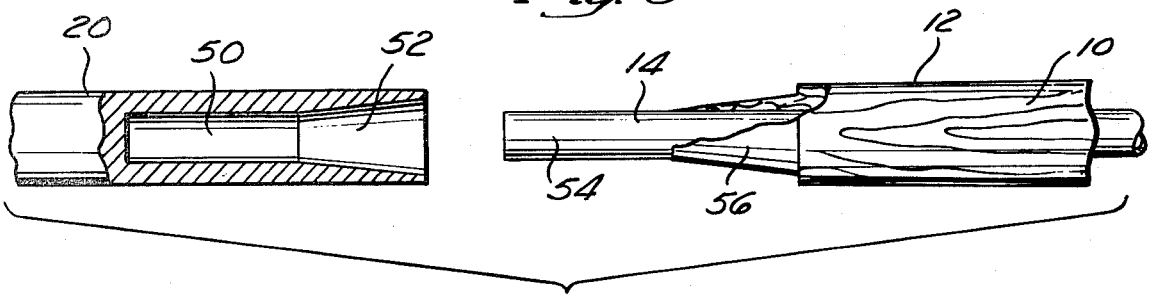
FIG. 9 is a partial, exploded side view of a fourth form of joinder of shaft and head.

FIG. 9 is much like FIG. 8 except there are cylindrical and flaring hosel portions 50, 52 and a cylindrical lower inner tube portion 54 and a tapered wood portion 56 fitting into hosel portions 50, 52. Like in FIG. 8, hairline cracks are reduced and any occurring are controlled.

Figure 10:
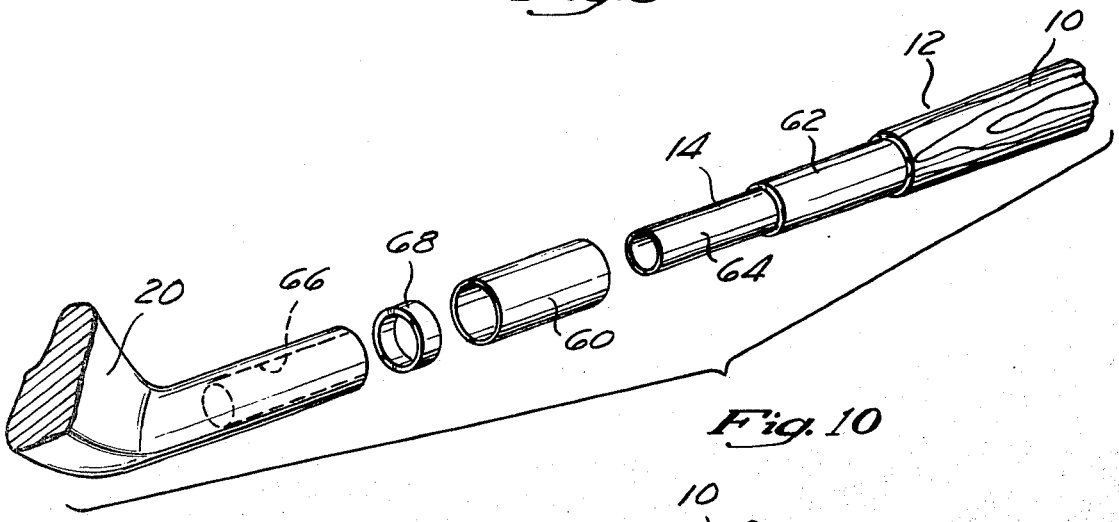
FIG. 10 is a partial, exploded perspective view of a fifth form of joinder of shaft and head.

FIG. 10 shows a thimble 60 fitting on a reduced diameter portion 62 of wood tube 10, in addition to the lower extended end 64 of inner tube 14 fitfing into a cylindrical hosel 66 in club head 20. Thimble 60 can be of the same metal, finish and color as head 20 so that it would look like a continuation of the head 20, if so desired. FIG. 10 shows the use of a ring 68, which can be of contrasting color, for purposes of ornamentation more than function. Thimble 60 can be used with or without ring 68. In either case, preferably thimble 60 and/or ring 68 are bonded to the reduced diameter wood portion 62 to control splitting. The FIG. 10 construction is something like the FIG. 8 construction except thimble 60 is substituted for the larger portion 44 of the FIG. 8 hosel.

Figure 11:
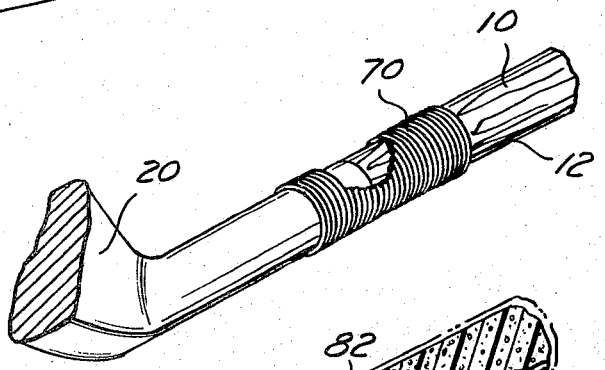
FIG. 11 is a partial perspective view of a further modification in joining shaft and head.

FIG. 11 shows cord whipping 70 to help control or conceal hairline cracking in the end of wood tube 10. Whipping 70 could be disposed in a reduced diameter lower end of tube 10. It is believed reduced diameter portions 46, 56, or 62 fitting in a portion of the hosel 44 or 52 or in a thimble 60 may better prevent or control cracking, whereas whipping 70 can be more cosmetic. Whipping also reduces twisting.

Figure 17:
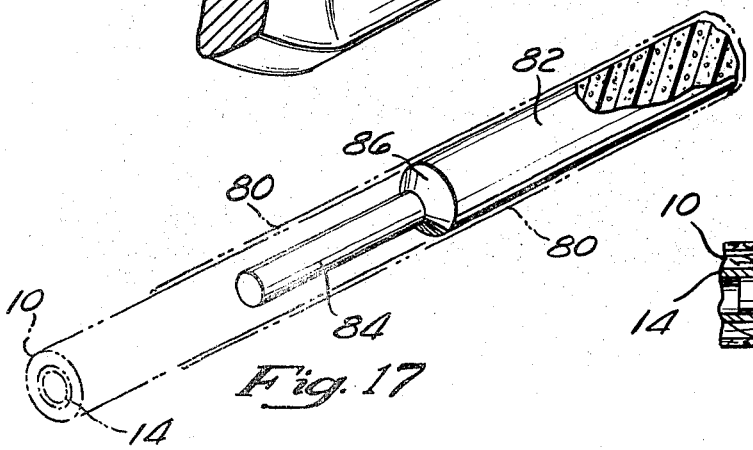
FIG. 17 is a perspective view of an attachment to the upper end of the club shaft, under the grip.
Figure 18:
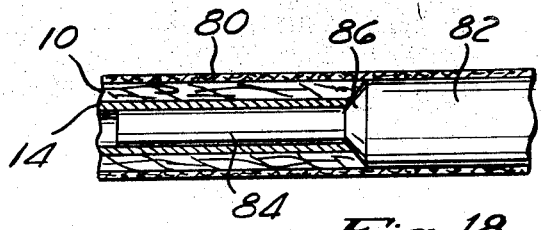
FIG. 18 is a fragmentary side view, partly in section, of the structure shown in FIG. 17.

The club head shaft 12 can have an extension 82 secured to the upper end of shaft 12 as indicated in FIGS. 17 and 18. The extension 82 is made of lighter material than the rest of shaft 12 and (a) slightly reduces the total dead weight of the shaft compared with a shaft of the same length made entirely with an outer wood tube 10 and an inner metal tube 14, and (b) shifts the balance point of shaft 12 slightly toward the club head 20 thereby changing the swing weight. In other words, the use of extension 82, made at least partly of plastic foam having a lower weight to length ratio than the remainder of shaft 12, changes dead weight and swing weight over a shaft of the same length without the use of plastic foam.

Extension 82 can be made primarily or entirely of self-skinning polyurethane foam, which is lighter than the combination of wood tube 10 and metal tube 14. The foam body can be made with an integral cylindrical boss 84 bonded within the adjacent end of metal tube 14 or metal tube 84 can be embedded within the body of foam extension 82 and bonded in the end of tube 14. The adjacent end surface 86 of shaft 12 and extension 82 can be squared and bonded together or can be beveled as shown particularly in FIG. 18 for extra strength of bond, which can be especially important if an embedded metal tube 84 is used. It is important that grip 80 cover the area of extension 82, as extension 82 would not look good if uncovered.

In the prior art, metal or wood extenders have been used on clubs merely to lengthen them and did not substantially change weight (did not act to reduce dead weight or to shift swing weight) like our foam extenders do. The extenders 82 preferably are used for all "woods" to extend lengths beyond thirty-six inch dowels used for making wood tubes 10. However, some "irons" may be shorter than thirty-six inches in order to accommodate extensions 82 in the right lengths of clubs.

Another way to make extension 82 is to make the upper end of the inner metal tube 14 longer than the upper end of the outer wood tube 10 and to provide a tubular polyurethane extension body around the upper extended end of the metal tube 14.

The lamination of materials in outer tube 10 and inner tube 14 bonded together, such as hickory and light-weight thin-walled steel tubing epoxied together, produces a golf club shaft 12 of exceptional strength and dampening abilities, while maintaining a light-weight shaft. Some of the physical characteristics will be reviewed below, with reference particularly to the diagrammatical illustrations of FIGS. 12 to 16. In each graphical view, the conventional steel club shaft is depicted on the left and the laminated club shaft of the present application is depicted on the right.

Figure 12:
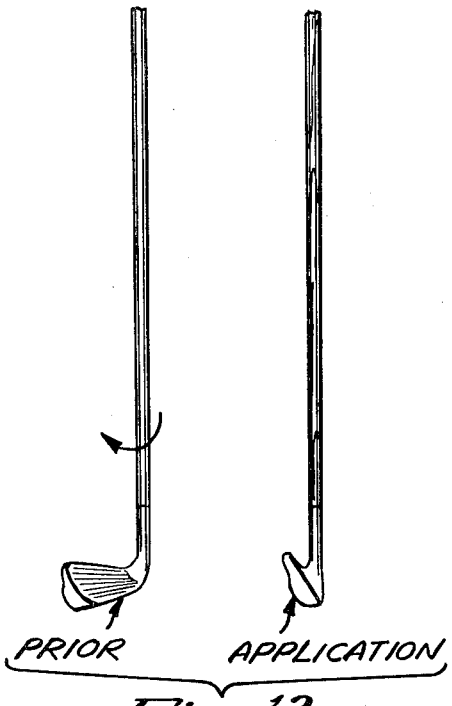
FIGS. 12–16 are diagrammatical views comparing conventional golf clubs with golf clubs made according to the present patent application as to physical attributes such as twist, flex and vibration. The amount of bending is exaggerated for clarity of disclosure.

In FIG. 12, the property of radial torque about the longitudinal axis of the club shaft is depicted. During swing and particularly ball impact, and especially due to off-center hits, club shafts tend to twist about their longitudinal axes. With our laminated shaft, the angular twisting or torsion is estimated to be about half of that with a conventional steel club shaft. To give an example, one of our shafts was tested as to angular deflection under torsion against a comparable conventional steel shaft with the same conditions of weight, moment arm, etc. The conventional steel shaft deflected 4–6 degrees and our laminated shaft deflected 2–3 degrees. Excessive torsion particularly in off-center hits can cause particularly bad shots, especially slices.

Figure 13:
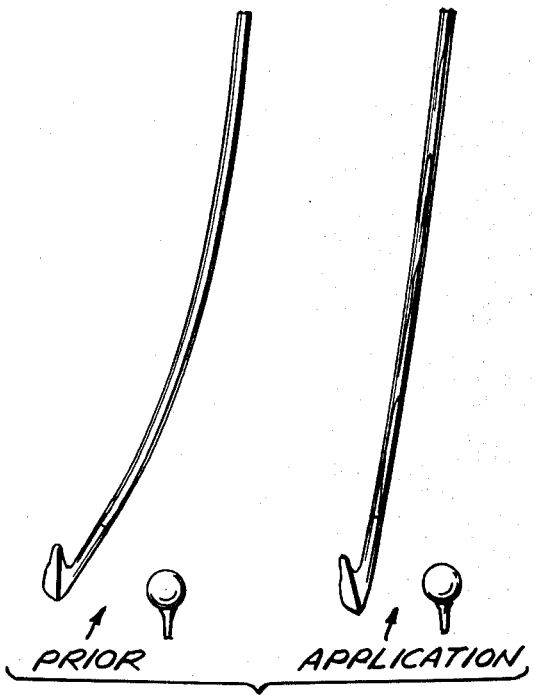

FIG. 13 concerns flexing or bending about lateral axes in downswing prior to impact. As graphically illustrated, the conventional shaft has more bending in downswing than our laminated shaft. With less flexing in our shaft, the club has to travel less arcuate distance, relative to a straight line representing the longitudinal axis of the shaft in the ideal, non-flexed condition. In the ideal, never realized condition of a club, there would be no bending or twisting of the shaft and the club head would have the ideal relationship to the ball, which is the basis for club head design. This is not to say that absolutely no flexing or twisting would be desirable as complete rigidity might not feel good, but it is to say that less flexing and twisting of the shaft as compared with a conventional steel shaft is highly desirable in producing better shots.

Figure 14:
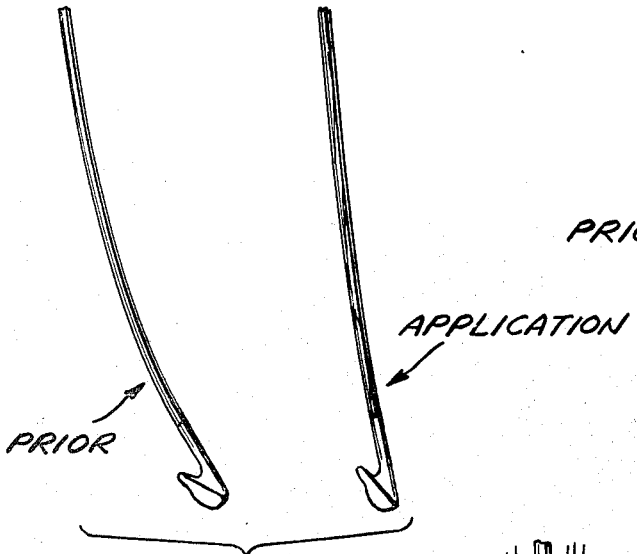

FIG. 14 concerns conditions after the club head and shaft have been recovered after the down swing. The club head and shaft flex or bend past a fully recovered position (in which the axis of the shaft is on a straight line). The club head and shaft also twist and loft is added to the club face. The twisting misalignment is to the right, opening up the club face, a condition tending to cause slicing. Such bending of the shaft, lofting of the club face, and twisting of the club face are greatly reduced in our laminated shaft as compared to prior conventional steel shafts.

Figure 15:
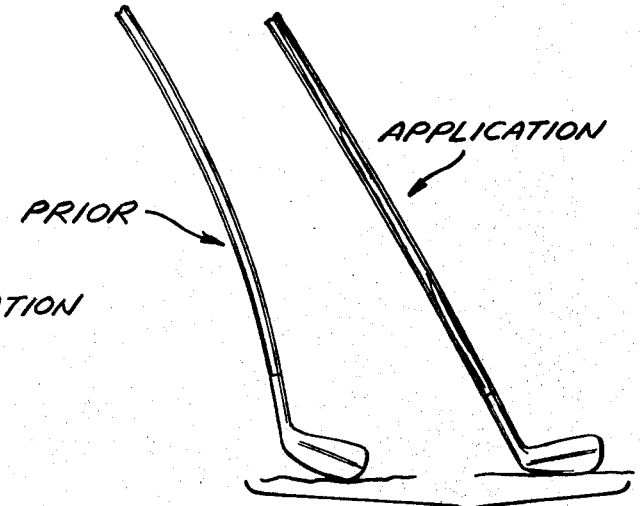

FIG. 15 concerns flexing caused by centrifugal force that makes the club head toe hit the ground before the club head heel. This flexing could be said to be generally in planes common to the club shaft and the player and at right angles to the plane of the swing, whereas the flexing in FIGS. 13 and 14 could be said to be generally in the plane of the swing and at right angles to the plane in FIG. 15. Obviously the FIG. 15 flexing changes the disposition of the face of the club head from an ideal disposition to one somewhat misaligned. The flexing of the type shown in FIG. 15 is reduced with our laminated shafts as compared with conventional steel shafts.

Figure 16:
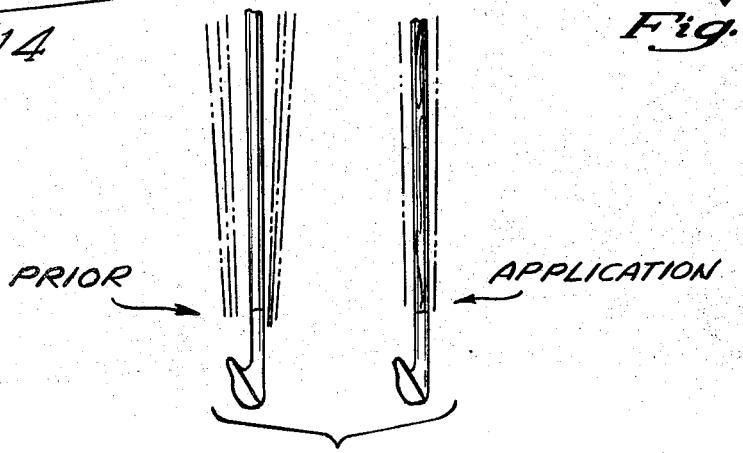

FIG. 16 deals with vibration and indicates our laminated shaft has a reduced level of vibrations as compared to conventional steel shafts. Our laminated shaft, perhaps particularly because of the solid wood, acts as a shock absorber dampening harsh vibrations caused by off-center hits, hardcovered balls, cold weather, cast steel heads, etc.

We do not know of a way to physically measure the difference in vibration dampening with our club but a player, particularly a proficient player or a professional, will have no doubt as to the difference. In fact, the improved properties represented in FIGS. 12 to 16 in general are ones felt by the proficient or professional player rather than necessarily those measured with equipment. They are not less real for being perceived rather than measured. As all experienced players can testify, there is a sweet spot on a club face, for example, even though the property or sensation may defy equipment measurement.

Having thus described our invention, we do not wish to be understood as limiting ourselves for the exact construction shown and described. Instead, we wish to cover those modifications of our invention that will occur to those skilled in the art upon learning of our invention and which are within the proper scope thereof.

We claim:

1. A golf club, comprising (a) an outer wood hollow tube having a bore of substantially uniform diameter from end to end thereof, (b) an inner rigid non-wood hollow tube positioned inside of and closely fitting the interior of said outer tube throughout at least the major extent of the length of said outer tube and said inner tube having a substantially uniform interior diameter and a substantially uniform exterior diameter throughout at least the major extent of the length of said inner tube, (c) an adhesive between the interior of said outer tube and the exterior of said inner tube bonding them together, and (d) a separate club head fastened to the lower end of said inner rigid non-wood hollow tube.

2. The subject matter of claim 1 in which said inner tube is formed from a material selected from the group consisting of chrome-moly steel, other steel alloys, aluminum, titanium, bonded graphite fibers, bonded boron fibers, bonded graphite-boron fibers, and bonded fiberglass fibers.

3. The subject matter of claim 1 in which said inner tube is formed of chrome-moly steel.

4. The subject matter of claim 1 in which said outer tube is formed from a material selected from the group consisting of hickory, ash and birch.

5. The subject matter of claim 1 in which said outer tube is formed from hickory.

6. The subject matter of claim 1 in which said adhesive is an epoxy.

7. The subject matter of claim 1 in which there is an extension fitted to the upper end of said shaft made at least partly of plastic foam and having a lower weight to length ratio than the remainder of said shaft in order to change dead weight and swing weight over a shaft of the same length without use of plastic foam.

8. The subject matter of claim 7 in which said extension has a cylindrical boss bonded within the upper end of said inner tube and the adjacent surfaces of said shaft and said extension are beveled and bonded together.

9. The subject matter of claim 1 in which there is means encircling and confining the lower end of said outer tube to control hairline cracks therein.

10. The subject matter of claim 9 in which said means is a cord whipped about said lower end of said outer tube.

11. The subject matter of claim 9 in which said means is a thimble separate from said club head.

12. The subject matter of claim 11 in which said thimble is bonded to said lower end of said outer tube.

13. The subject matter of claim 9 in which said means is a hosel that is part of said club head.

14. The subject matter of claim 13 in which said hosel is bonded to said lower end of said outer tube.

15. The subject matter of claim 14 in which the interior os said hosel is tapered and said lower end of said outer tube is tapered to fit the taper of said hosel.

16. The subject matter of claim 9 in which said lower end of said outer tube is of reduced diameter relative to the remainder of said outer tube in the area of said means.

17. The subject matter of claim 1 in which said club head has a hosel with a generally cylindrical socket and the lower end of said inner tube extends beyond the lower end of said outer tube and fits into said socket

18. The subject matter of claim 1 in which said club head has a cylindrical boss secured in the lower end of said inner tube to fasten said head to said shaft.

* * * * *

REEXAMINATION CERTIFICATE (567th)

United States Patent [19]

Parente et al.

[11] B1 4,470,600

[45] Certificate Issued Sep. 16, 1986

[54] GOLF CLUB

[75] Inventors: Richard E. Parente, Palm Springs; Richard De La Cruz, Pauma Valley, both of Calif.

[73] Assignee: Hickory Stick USA, Temecula, Calif.

Reexamination Request:
No. 90/000,921, Dec. 9, 1985

Reexamination Certificate for:

| | |
|---|---|
| Patent No.: | **4,470,600** |
| Issued: | **Sep. 11, 1984** |
| Appl. No.: | **386,931** |
| Filed: | **Jun. 10, 1982** |

[51] Int. Cl.[4] ..... A63B 53/02; A63B 53/10

[52] U.S. Cl. ..... 273/80 B; 273/80.3; 273/80.5; 273/80.8

[58] Field of Search ..... 273/80 B, 80 R, 81 R, 273/80 A, 80 C, 80 D, 80.2–80.9

[56] References Cited

FOREIGN PATENT DOCUMENTS

| | | | |
|---|---|---|---|
| 52-122160 | 11/1977 | Japan | 273/80 B |
| 52-151857 | 11/1977 | Japan | 273/80 B |
| 20726 | of 1909 | United Kingdom | 273/80 B |

*Primary Examiner*—George J. Marlo

[57] ABSTRACT

A golf club with an outer tube formed from hickory, ash or birch and with an inner hollow tube formed of chrome-moly or other steelalloy aluminum, titanium, graphite fibers, boron fibers, graphite-boron fibers or fiberglass fibers. The outer tube has a bore of uniform diameter from end to end that closely fits the inner tube which has uniform inner and outer diameters from end to end. An epoxy adhesive bonds the tubes together. The wood tube is bored by a riflebore drill on an engine lathe, from a larger piece of wood which is turned to a smaller diameter after drilling. An extension of the shaft upper end of lower weight-to-length ratio than the remainder of the shaft, formed at least partly of plastic foam, and secured with a cylindrical boss bonded within the upper end of the inner tube. The lower end of the shaft is confined, to reduce hairline splitting of the wood tube, by the club head hosel or by cord whipping, and the shaft has various kinds of connections to the club head.

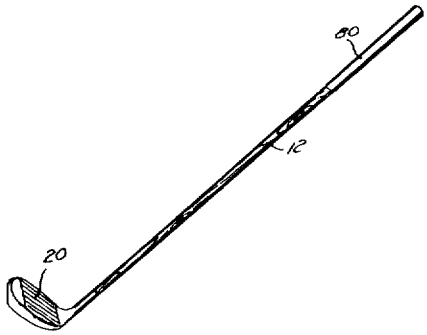

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–18, dependent on an amended claim, are determined to be patentable.

1. A golf club, comprising (a) [an outer wood hollow tube] *an outer solid natural wood hollow tube having structural characteristics corresponding to those resulting from having been made by boring and turning a larger piece of solid natural wood, which is distinctly different from man made laminated wood, and* having a bore of substantially uniform diameter from end to end thereof, (b) an inner rigid non-wood hollow tube positioned inside of and closely fitting the interior of said outer tube throughout at least the major extent of the length of said outer tube and said inner tube having a substantially uniform interior diameter and a substantially uniform exterior diameter throughout at least the major extent of the length of said inner tube, (c) an adhesive between the interior of said outer tube and the exterior of said inner tube bonding them together, and (d) a separate club head fastened to the lower end of said inner rigid non-wood hollow tube.

* * * * *